United States Patent [19]

Rao

[11] 4,198,0

[45] Apr. 15, 19

[54] MORTISED BLOCK PUZZLE

[76] Inventor: M. Prabhakar Rao, 15 Canterbury St., Dartmouth, Nova Scotia, Canada, B2Y IS8

[21] Appl. No.: 864,865

[22] Filed: Dec. 27, 1977

[51] Int. Cl.[2] ..... A63F 9/12

[52] U.S. Cl. ..... 273/160

[58] Field of Search ..... 273/160; 35/27, 71; 46/16

[56] References Cited

U.S. PATENT DOCUMENTS

| | | | |
|---|---|---|---|
| 1,270,181 | 6/1918 | McElveen | 273/160 |
| 2,836,421 | 5/1958 | Turner | 273/160 |

FOREIGN PATENT DOCUMENTS

| | | | |
|---|---|---|---|
| 94613 | 6/1905 | Canada | 273/160 |
| 2048425 | 4/1972 | Fed. Rep. of Germany | 46 |
| 752128 | 7/1933 | France | 273/ |
| 2252111 | 6/1975 | France | 46 |
| 157153 | 8/1921 | United Kingdom | 273/ |

*Primary Examiner*—Anton O. Oechsle

*Attorney, Agent, or Firm*—Barrigar & Oyen

[57] ABSTRACT

A block puzzle consisting of three blocks, one be characteristically "O"-shaped and the other two e: being characteristically "C"-shaped, is described. T blocks are slidably engageable into a mutually perp dicular interlocking arrangement in which each bl passes through the other two blocks substantially c cealing the "O"-shape of the one block and the "( shape of the other two blocks. In various embodime the central openings in the blocks are respectively re angular, oval and hexagonal in shape.

5 Claims, 5 Drawing Figures

MORTISED BLOCK PUZZLE

FIELD OF THE INVENTION

This invention relates to block puzzles of the type wherein component blocks are adapted to be assembled into a specified relationship referred to as a "solution." More particularly, the present invention relates to a class of block puzzles wherein component blocks are adapted to be assembled into a mutually perpendicular interlocking arrangement.

BACKGROUND OF THE INVENTION

Block puzzles of the class to which the present invention relates have been known for many years. It is recognized that they can provide not only a source of amusement and diversion, but also a test of skill and perceptive ability. Typically, the component blocks are rectilinear in shape and are provided with recesses, notches or the like which permit assembly of the puzzle into a desired "solution." When so assembled, the blocks appear to pass through one another in three dimensions; and the recesses, notches or the like are substantially concealed from view. Block puzzles of this class are disclosed in U.S. Pat. No. 2,836,421 granted to W. D. Turner on May 27, 1958, and in Canadian Pat. No. 94,613 granted to S. J. Curtis on June 17, 1905.

The patents to Turner and Curtis disclose block puzzles having a relatively large number of component blocks. Eleven blocks are used for a solution to the block puzzle disclosed by Curtis; six blocks are used for a solution to the block puzzle disclose by Turner. In each case, a relatively complex array of notches and slots are provided in the component blocks.

It is recognized that in some case a block puzzle consisting of a relatively large number of component blocks may be desirable. However, it is considered that a block puzzle consisting of relatively few component blocks is also desirable. Individuals are less apt to be discouraged from seeking a solution to a block puzzle consisting of relatively few blocks than they are when confronted with a seemingly complex puzzle consisting of a relatively large number of blocks. Moreover, from the point of view of manufacturing the component blocks or a block puzzle on a production scale, it is obviously preferable to have as few differently shaped blocks as possible.

An object of the present invention is to provide a block puzzle of the class described, and which has a minimal number of component blocks.

A further object of the present invention is to provide a block puzzle where there may be minimal variation in the geometry of the component blocks.

SUMMARY OF THE INVENTION

In a broad aspect of the present invention, there is provided a block puzzle consisting of three blocks, one of which has a characteristic "O"-shape, and two of which have a characteristic "C"-shape. The blocks are slidably engageable into a mutually perpendicular interlocking arrangement in which each block passes through the other two blocks substantially concealing the "O"-shape of the one block and the "C"-shape of the other two blocks.

The "O"-shape of the one block is formed by an aperture passing through the block. The "C"-shape of the other two blocks is formed by a "T"-shaped slot passing through the block. The "T"-shape may be thought of as consisting of a "cap portion" (viz. the to of the "T") and a "stem portion" (viz. the portion of th "T" extending transversely down from the cap poı tion).

For a given block puzzle, the dimensions of the apeı ture of the "O"-shaped block and the dimensions of th cap portion of the slots of the "C"-shaped blocks ar substantially the same. However, as will be seen, ther are a variety of possible shapes for the blocks.

Preferably, apart from the stem portion of the "T" shaped slots in two blocks, the overall shape of th component blocks for a block puzzle in accordanc with the present invention are substantially the same The "solution" to the puzzle will then have geometri symmetry in three dimensions. Also, to manufacture th blocks on a production scale, it would then only b necessary to have manufacturing provision for tw different blocks rather than three different blocks (viz. facility to manufacture "O"-shaped blocks and a facilit to manufacture "C"-shaped blocks).

It may be noted that U.S. Pat. No. 1,270,181 grante to A. McElveen discloses a puzzle which may consist o only three blocks. One of the blocks is "O"-shaped an the other two blocks could be said to be "C"-shaped However, the "C"-shape of the two blocks is not im parted by a "T"-shaped slot as in the case of the presen invention; rather, it is imparted by a notch or recess ı the block. Moreover, the puzzle disclosed by McElveeı is not one wherein the component blocks are assemble into a mutually perpendicular interlocking arrange ment. When the puzzle is assembled, the two "C" shaped blocks stand in parallel relation to each othe rather than in a mutually perpendicular interlockin relation. Further the component blocks of the McEl veen puzzle do not slidably engage to arrive at a solu tion—the solution depends upon mechanical distortioı to engage the blocks.

The present invention will now be described witl reference to the drawings.

DETAILED DESCRIPTION WITH REFERENCE TO THE DRAWINGS

Figure 1:
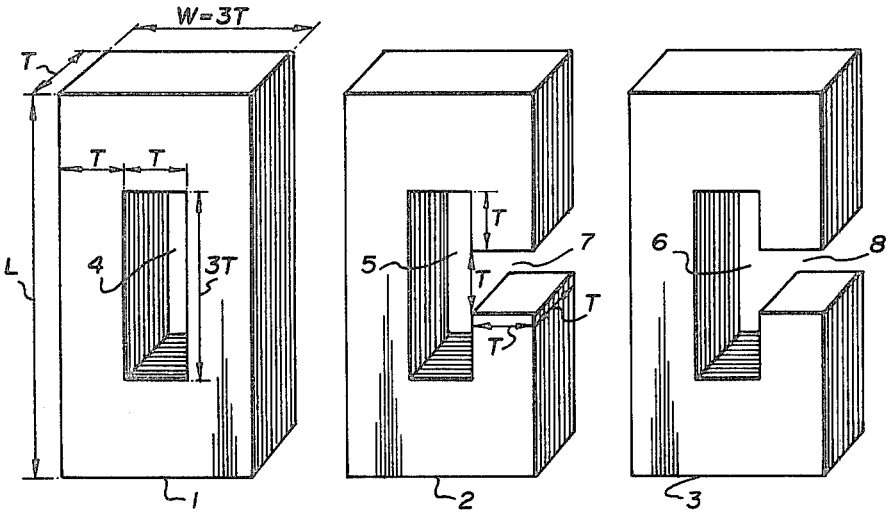
FIG. 1 is a perspective view illustrating componen blocks of a block puzzle in accordance with the presen invention.
Figure 2:
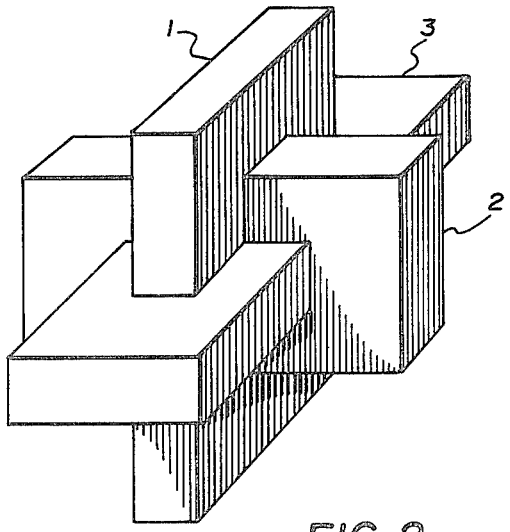
FIG. 2 shows a perspective view of a final solution t a block puzzle using the blocks of FIG. 1.
Figure 3:
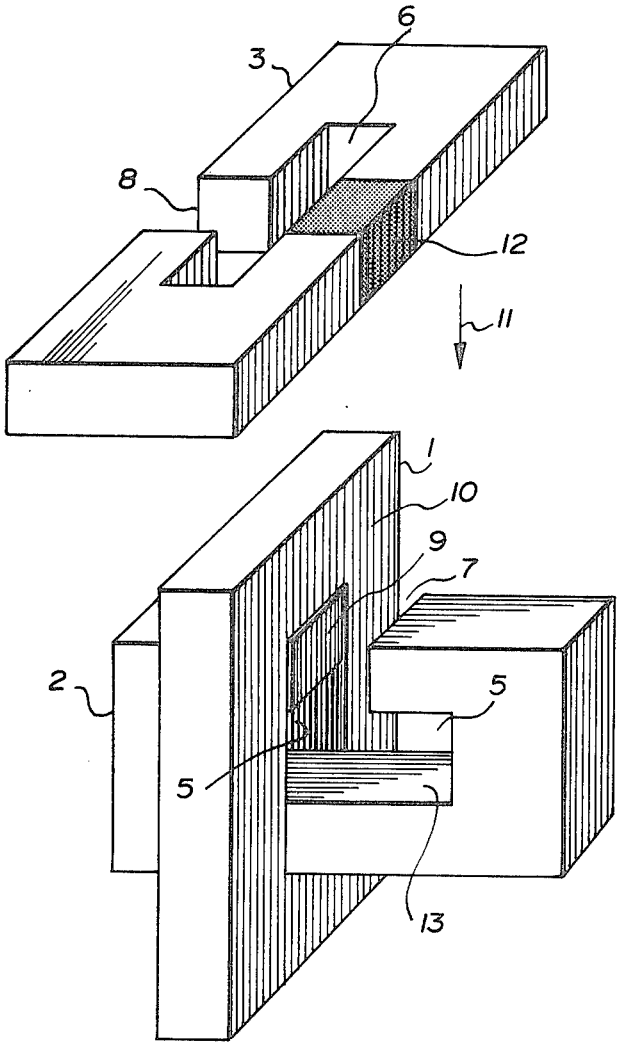
FIG. 3 shows a perspective view of a partially com pleted solution to a block puzzle using the blocks o FIG. 1.

FIGS. 1, 2 and 3 illustrate a block puzzle at variou stages of assembly. The shape of the component block is entirely rectilinear. In the usual course of events, person would be presented with blocks 1, 2 and 3 a shown in FIG. 1 and be required to assemble the block into the arrangement shown in FIG. 2. He or she shoul not have the benefit of viewing the intermediate stage o assembly shown in FIG. 3.

For purposes of simplifying the following discussion, ıere will be no immediate reference to tolerancing of arious dimensions. When, for example, it is said or nplied that a block having a specified thickness, (say ıickness "X") slides into a space having the same speci- ed dimension "X" to accommodate such thickness, ıen it is to be understood and inferred that there is ıitable tolerancing of the dimensions to permit the lock to readily slide into the space.

Block 1 has a length L, a width W, and a depth or ıickness T as indicated in FIG. 1. The width W is three mes the thickness T (or 3T), and the length L is a ɜngth greater than three times the thickness T. Block 1 ; given a characteristic "O"-shape by the presence of perture 4 which passes depthwise through the block, nd which is centrally disposed widthwise and length- ʼise of the block. It may be formed, or conceived of as aving been formed, by removing from the central ortion for a rectangular parallelopiped of dimensions ., W and T, a piece of material in the shape of a smaller ɜctangular parallelopiped having dimensions T lepth), T (width), and 3T (length) with surfaces paral- ɜl to those of the larger block 1.

As can be seen in FIG. 1, blocks 2 and 3 each have a haracteristic "C"-shape which is imparted by the pres- nce of a "T"-shaped slot in each block. In block 2, the T"-shaped slot consists of a cap portion 5 and a stem ortion 7. In block 3, the "T"-shaped slot consists of a ap portion 6 and a stem portion 8. The dimensions of locks 2 and 3 are substantially the same as each other, nd, apart from the provision of stem portions 7 and 8, ıe dimensions of blocks 2 and 3 are substantially the ıme as those of block 1. Stem portions 7 and 8 may be ɔrmed, or conceived of as having been formed, by ɜmoving a central one-third portion of that part of a lock such as block 1 which part forms a longitudinal de of an aperture such as aperture 4 in block 1. Such entral one-third portion is a cubic parallelopiped hav- ıg dimensions T on each side. Thus, the stem portions re cubic having dimensions T on each side.

The purpose of stem portions 7 and 8 becomes appar- nt with reference to FIG. 3 which illustrates an inter- ıediate stage in the assembly of the puzzle. To "solve" ıe puzzle, the first step is to insert block 2 into aperture of block 1 to the position shown in FIG. 3 where face of block 2 is flush with face 10 of block 1. When block is in this position, the next step is to move block 3 ownward in the direction of arrow 11 until the lower ıce (not shown) of the portion 12 of block 3 (which ortion is emphasized by shading for purposes of illus- ·ation in FIG. 3) abuts face 13 of block 2. During this ɜp, block 1 passes through the rectangular aperture 6 f block 3, block 2 passes edgewise through stem por- on 8, and portion 12 of block 3 passes through stem ortion 7 and into rectangular aperture 5 of block 2. 'inally, after block 3 has been moved into the abutting osition described, block 2 is moved to the left in FIG. until stem portion 7 of block 2 has disappeared into ɜctangular aperture 4 of block 1. The blocks will then e assembled as is shown in FIG. 2 and the presence of perture 4 in block 1 and the "T"-shaped slots in blocks and 3 will not be readily apparent.

A cursory consideration of FIGS. 2 and 3 reveals that ıe respective lengths of each of the blocks do not have ɔ be the same nor does the rectangular aperture of any ne or more the blocks have to be centered lengthwise f the block. The respective lengths and such centering nly bears upon the symmetry of the assembled puzzle.

Tolerances

The required tolerancing of various dimensions should be readily apparent to those skilled in the art. Theoretically, it can perhaps be said that if the width of block 2 is 3T and the thickness of block 2 is T, and if the width of aperture 4 in block 1 is T and the length of aperture 4 in block 1 is 3T, then block 2 can be made to engage block 1 in the manner shown in FIGS. 2 and 3. However, as a practical matter, it will likely be considered preferable to make the width of aperture 4 slightly greater than T and the length of aperture 4 slightly greater than 3T. Similar considerations apply to the dimensions of cap portions 5, 6 and stem portions 7, 8 in blocks 2 and 3.

For ease of manufacturing, it is preferable that blocks 2 and 3 be made substantially identical. This would contemplate that blocks 2 and 3 are interchangeable in the solution of the puzzle. However, if considered desirable, the tolerancing of various dimensions of blocks 2 and 3 may be such that blocks 2 and 3 are not interchangeable. Assuming that the distance between the opposed faces of block 2 defining stem portion 7 is made slightly less than precisely T, then blocks 1, 2 and 3 can still be assembled in the manner indicated in FIGS. 2 and 3 provided that portion 12 of block 3 can still pass through stem portion 7 in the manner shown. This will be possible if the width of cap portion 6 in block 3 is toleranced sufficiently wide. Stem portion 8 of block 3 remains suitably toleranced to receive block 2 (having thickness T) edgewise when block 3 is moved in the direction of arrow 11 in FIG. 3. If blocks 2 and 3 are interchanged it will be apparent that the puzzle could not be assembled in the manner indicated in FIG. 3. With the interchange, stem portion 7 of block 2 would be in the position of stem portion 8 of block 3, and would thus be required to receive block 3 (having a thickness T) edgewise for assembly of the puzzle. This would not be possible because the width of slot 7 in block 2 (being slightly less than T) could not accommodate the greater thickness (T) of block 3.

Materials

Various suitable materials may be used for blocks made in accordance with the present invention. For example, block or laminate wood structures are suitable, as are solid plastics.

Variants

The particular structure described thus far is considered to be desirable because the component blocks are geometrically simple and are relatively easy to manufacture. However, there are a variety of other structures within the ambit of the present invention.

Figure 4:
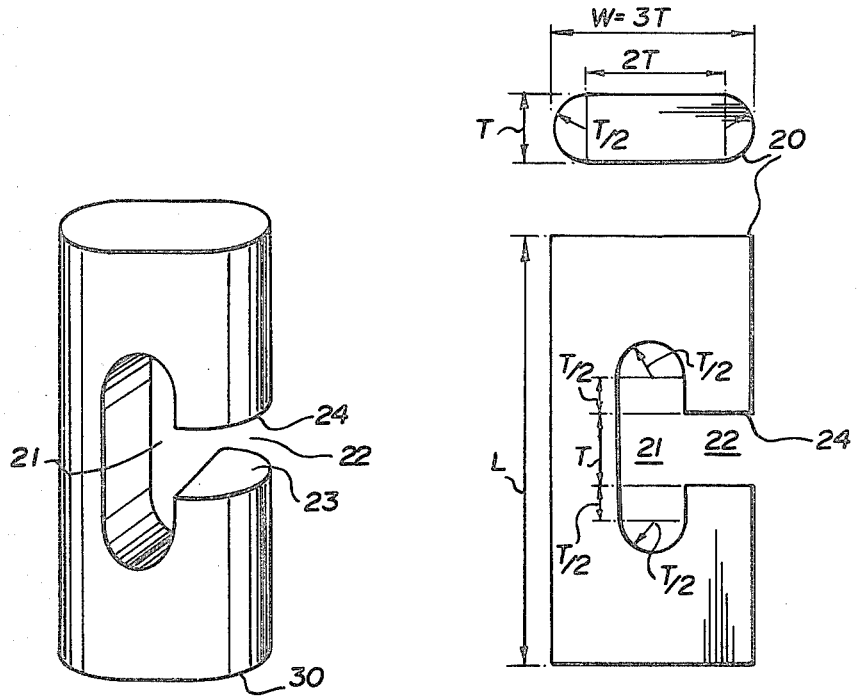
FIG. 4 shows a perspective, plan and top view of on component block of a variant block puzzle in accor dance with the present invention.

A portion of one possible variant block puzzle is shown in FIG. 4. FIG. 4 illustrates a generally "C"-shaped block 20, including a "T"-shaped slot consisting of a cap portion 21 and a stem portion 22. Block 20 has a length L, a dep th or thickness T, and a depth W equal to three times the thickness T. As may be seen with reference to the plan view of block 20, the cap portion 21 has a uniform oval cross-section which may be thought of as consisting of a central rectangular portion having a width T (measured widthwise of block 20) and a length 2T (measured lengthwise of block 20) combined with two semicircular end portions, one at each lengthwise end of the rectangular portion, each having a radius T/2. Referring to the top view of block 20, it will be noted that the cross-section of the block taken widthwise and depthwise of the block is such as to permit the block to be lengthwise slidably engaged into a cap portion of a "T"-shaped slot having dimensions like cap portion 21. The cross-section of stem portion 22 taken widthwise and depthwise in relation to block 20 may be thought of as consisting of a rectangular portion having a width T (depthwise of block 20) and a length T/2 (widthwise of block 20) combined with a semicircular end portion having a radius T/2. The complete block puzzle in accordance with the present invention and which includes block 20 as shown in FIG. 4 would also include a second block (not shown) like block 20, and a third block (not shown) like block 20 but without the opening presented by stem portion 22. A "solution" to the puzzle thus defined would preceed in essentially the same manner as the "solution" described for the block puzzle of FIGS. 1, 2 and 3.

Figure 5:
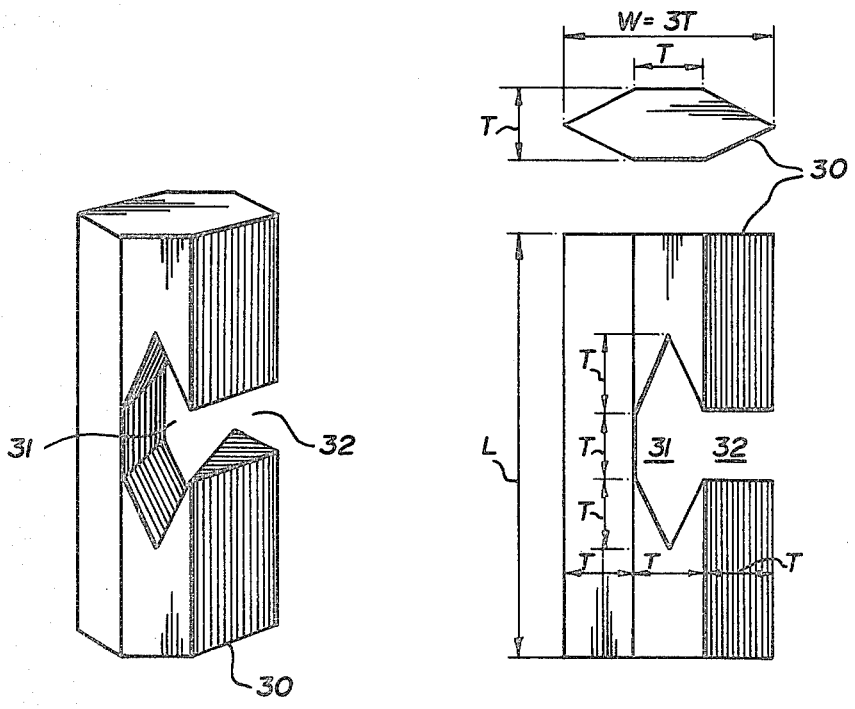
FIG. 5 shows a perspective, plan and top view of on component block of another variant block puzzle ı accordance with the present invention.

FIG. 5 illustrates a portion of another variant block puzzle in accordance with the present invention. This portion is a generally "C"-shaped block 30, including a "T"-shaped slot consisting of a cap portion 31 and a stem portion 32. Block 30 has a length L, a depth or thickness T, and a width W equal to three times the thickness T. As may be seen with reference to the plan view of block 30, the cap portion has a generally hexagonal cross-section which may be thought of as consisting of a central square portion having a width T (widthwise of block 30) and a length T (lengthwise of block 30) combined with two isosceles triangular end portions, one at each lengthwise end of the square portion. Each triangular end portion has a base of length T contiguous with a lengthwise end of the central square portion and a height of length T. Referring to the top view of block 30, it will be noted that the cross section of the block taken widthwise and depthwise of the block is such as to permit the block to be lengthwise slidably engaged into a cap portion of a "T"-shaped slot having dimensions like cap portion 31. The cross-section of stem portion 32 taken widthwise and depthwise in relation to block 30 may be thought of as an isosceles triange having a base of length T (depthwise of block 30) and a height T (widthwise of block 30). A complete block puzzle in accordance with the present invention and which includes block 30 as shown in FIG. 5 would also include a second block (not shown) like block 30, and a third block (not shown) like block 30 but without the opening presented by stem portion 32. A "solution" to the puzzle thus defined would proceed in essentially the same manner as the "solution" described for the block puzzle of FIGS. 1, 2 and 3.

Other variations which do not detract from the interlocking arrangement of the present invention as it is generally conceived, are possible or may become apparent to those skilled in the art. For example, component blocks 1, 2 and 3 shown in FIGS. 1, 2 and 3 may be streamlined or curved over the portions of the blocks exposed to view when the blocks 1, 2 and 3 are assembled into the "solution". To the extent that such variations or other variations within the proper scope of the following claims do occur to other persons, it is to be understood that they constitute part of the present invention.

I claim:

1. A block puzzle consisting of:

(a) a first block having a characteristic "O"-shape imparted by a non-rectangular aperture in said first block; and (b) second and third blocks, each of which blocks a characteristic "C"-shape imparted by a "T shaped slot in the block;

said blocks being slidably engageable into a mutua perpendicular interlocking arrangement in which ea block passes through the other two blocks substantia concealing the "O"-shape of said first block, the "C shape of said second block, and the "C"-shape of s third block.

2. A block puzzle consisting of:

(a) a first block having a length, a depth, and a wic substantially equal to three times said depth, a having a characteristic "O"-shape imparted by aperture extending lengthwise of the block, c trally disposed widthwise of the block and passi depthwise through the block;

(b) a second block having a length, a depth subst tially equal to said depth of said first block, anc width substantially equal to said width of said fi block, and having a characteristic "C"-shape i parted by a "T"-shaped slot, said "T"-shaped s consisting of:

(i) a cap portion extending lengthwise of the bloc centrally disposed widthwise of the block a passing depthwise through the block;

(ii) a stem portion extending widthwise of the blo transversely from a lengthwise side of said c portion and passing through the block;

(c) a third block having a length, a depth substantia equal to said depth of said first block and a wic substantially equal to said width of said first bloc and having a characteristic "C"-shape imparted a "T"-shaped slot, said "T"-shaped slot consisti of:

(i) a cap portion extending lengthwise of the bloc centrally disposed widthwise of the block a passing depthwise through the block;

(ii) a stem portion extending widthwise of the blo transversely from a lengthwise side of said c portion and passing depthwise through t block;

wherein:

(A) the cross-section of said first block tak widthwise and depthwise of said first block such as to permit said first block to be lengthw slidably engaged into said cap portion of t "T"-shaped slot of said second block, and such to permit said first block to be lengthwise sli ably engaged into said cap portion of the "T shaped slot of said third block;

(B) the cross-section of said second block tak widthwise and depthwise of said second block such as to permit said second block to be lengt wise slidably engaged into said aperture of sa first block, and such as to permit said seco block to be lengthwise slidably engaged into sa cap portion of the "T"-shaped slot of said thi block;

(C) the cross-section of the said third block tak widthwise and depthwise of said third block such as to permit said third block to be lengt wise slidably engaged into said aperture of sa first block, and such as to permit said third blo to be lengthwise slidably engaged into said c portion of the "T"-shaped slot of said seco block;

and wherein:

ı) said aperture of said first block has a substantially uniform oval cross-section taken lengthwise and widthwise in relation to said first block, said oval cross-section consisting of:

(i) a centrally disposed rectangular portion, the length of which portion measured lengthwise of said first block is substantially equal to two times said depth, the width of which portion measured widthwise of said first block is substantially equal to said depth;

(ii) two semicircular end portions disposed one at each lengthwise end of said rectangular portion, each semicircular end portion having a radius substantially equal to one half said depth;

ɔ) said cap portion of the "T"-shaped slot of said second block has a substantially uniform oval cross-section taken lengthwise and widthwise in relation to said second block, said oval cross-section consisting of:

(i) a centrally disposed rectangular portion, the length of which portion measured lenghwise of said second block is substantially equal to two times said depth, the width of which portion measured widthwise of said second block is substantially equal to said depth;

(ii) two semicircular end portions disposed one at each lengthwise end of said rectangular portion, each semicircular end portion having a radius substantially equal to one half said depth;

ɔ) said cap portion of the "T"-shaped slot of said third block has a substantially uniform oval cross-section taken lengthwise and widthwise in relation to said third block, said oval cross-section consisting of:

(i) a centrally disposed rectangular portion, the length of which portion measured lengthwise of said third block is substantially equal to two times said depth, the width of which portion measured widthwise of said third block is substantially equal to said depth;

(ii) two semicircular end portions disposed one at each lengthwise end of said rectangular portion, each semicircular end portion having a radius substantially equal to one half said depth;

d) said stem portion of the "T"-shaped slot of said second block has a substantially uniform cross-section taken depthwise and widthwise in relation to said second block, said cross-section of said stem portion consisting of:

(i) a rectangular portion, the length of which portion measured widthwise of said second block is substantially equal to one half said depth; the width of which portion measured lengthwise of said second block is substantially equal to said depth;

(ii) a semicircular portion having a radius substantially equal to one half said depth, the base of said semicircular portion being contiguous with the lengthwise end of said rectangular portion away from said cap portion of the "T"-shaped slot of said second block;

ɔ) said stem portion of the "T"-shaped slot of said third block has a substantially uniform cross-section taken depthwise and widthwise in relation to said third block, said cross-section of said stem portion consisting of:

(i) a rectangular portion, the length of which portion measured widthwise of said third block is substantially equal to one half said depth; the width of which portion measured lengthwise of said second block is substantially equal to said depth;

(ii) a semicircular portion having a radius substantially equal to one half said depth, the base of said semicircular portion being contiguous with the lengthwise end of said rectangular portion away from said cap portion of the "T"-shaped slot of said third block;

(f) said blocks beings slidably engageable into a mutually perpendicular interlocking arrangement in which each block passes through the other two blocks substantially concealing the "O"-shape of said first block, the "C"-shape of said second block, and the "C"-shape of said third block.

3. A block puzzle consisting of:

(a) a first block having a length, a depth, and a width substantially equal to three times said depth, and having a characteristic "O"-shape imparted by an aperture extending lengthwise of the block, centrally disposed widthwise of the block and passing depthwise through the block;

(b) a second block having a length, a depth substantially equal to said depth of said first block, and a width substantially equal to said width of said first block, and having a characteristic "C"-shape imparted by a "T"-shaped slot, said "T"-shaped slot consisting of:

(i) a cap portion extending lengthwise of the block, centrally disposed widthwise of the block and passing depthwise through the block;

(ii) a stem portion extending widthwise of the block transversely from a lengthwise side of said cap portion and passing through the block;

(c) a third block having a length, a depth substantially equal to said depth of said first block, and a width substantially equal to said width of said first block, and having a characteristic "C"-shape imparted by a "T"-shaped slot, said "T"-shaped slot consisting of:

(i) a cap portion extending lengthwise of the block, centrally disposed widthwise of the block and passing depthwise through the block;

(ii) a stem portion extending widthwise of the block transversely from a lengthwise side of said cap portion and passing depthwise through the block;

wherein:

(A) the cross-section of said first block taken widthwise and depthwise of said first block is such as to permit said first block to be lengthwise slidably engaged into said cap portion of the "T"-shaped slot of said second block, and such as to permit said first block to be lengthwise slidably engaged into said cap portion of the "T"-shaped slot of said third block;

(B) the cross-section of said second block taken widthwise and depthwise of said second block is such as to permit said second block to be lengthwise slidably engaged into said aperture of said first block, and such as to permit said second block to be lengthwise slidably engaged into said cap portion of the "T"-shaped slot of said third block;

(C) the cross-section of said third block taken widthwise and depthwise of said third block is such as to permit said third block to be lengthwise slidably engaged into said aperture of said first block, and such as to permit said third block to be lengthwise slidably engaged into said cap portion of the "T"-shaped slot of said second block;

and wherein:

(a) said aperture of said first block has a substantially uniform hexagonal cross-section taken lengthwise and widthwise in relation to said first block, said hexagonal cross-section consisting of:

(i) a centrally disposed square portion, the length of each side of said square portion measured lengthwise and widthwise of said first block being substantially equal to said depth;

(ii) two isosceles triangle end portions disposed one at each side of said square portion which sides extend widthwise of said first block, each triangular end portion having a base contiguous with a side end of said square portion, and having a height substantially equal to said depth;

(b) said cap portion of the "T"-shaped slot of said second block has a substantially uniform hexagonal cross-section taken lengthwise and widthwise in relation to said second block, said hexagonal cross-section consisting of:

(i) a centrally disposed square portion, the length of each side of said square portion measured lengthwise and widthwise of said second block being substantially equal to said depth;

(ii) two isosceles triangle end portions disposed one at each side of said square portion which sides extend widthwise of said second block, each triangular end portion having a base contiguous with a side end of said square portion, and having a height substantially equal to said depth;

(c) said cap portion of the "T"-shaped slot of said third block has a substantially uniform hexagonal cross-section taken lengthwise and widthwise in relation to said third block, said hexagonal cross-section consisting of:

(i) a centrally disposed square portion, the length of each side of said square portion measured lengthwise and widthwise of said third block being substantially equal to said depth;

(ii) two isosceles triangle end portions disposed one at each side of said square portion which sides extend widthwise of said third block, each triangular end portion having a base contiguous with a side end of said square portion, and having a height substantially equal to said depth;

(d) said stem portion of the "T"-shaped slot of said second block has a substantially uniform isosceles triangle cross-section taken depthwise and widthwise in relation to said second block, the base of said triangle being contiguous with the cap portion of the "T"-shaped slot of said second block, measured the length of said base lengthwise of said second block being substantially equal to said depth, the height of said triangle being substantially equal to said depth;

(e) said stem portion of the "T"-shaped slot of said third block has a substantially uniform isosceles triangle cross-section taken depthwise and widthwise in relation to said third block, the base of said triangular being contiguous with the cap portion of the "T"-shaped slot of said third block, the length of said base measured lengthwise of said third block being substantially equal to said depth, the height of said triangle being substantially equal to said depth;

(f) said blocks being slidably engageable into a mutually perpendicular interlocking arrangement in which each block passes through the other two blocks substantially concealing the "O"-shape of said first block, the "C"-shape of said second block and the "C"-shape of said third block.

4. A block puzzle as defined in claim 2, wherein the shape and dimensions of said first, second and third blocks are substantially the same, apart from the provision of said stem portions in said second and third blocks.

5. A block puzzle as defined in claim 3, wherein the shape and dimensions of said first, second and third blocks are substantially the same, apart from the provision of said stem portions in said second and third blocks.

* * * * *